United States Patent [19]

Junkers

[11] Patent Number: 4,644,829

[45] Date of Patent: Feb. 24, 1987

[54] FLUID-OPERATED WRENCH

[76] Inventor: John K. Junkers, 7 Arrowhead La., Saddle River, N.J. 07458

[21] Appl. No.: 768,036

[22] Filed: Aug. 21, 1985

[51] Int. Cl.[4] ..... B25B 13/46

[52] U.S. Cl. ..... 81/57.39

[58] Field of Search ..... 81/57.39, 57.4, 57.18

[56] References Cited

U.S. PATENT DOCUMENTS

| | | | |
|---|---|---|---|
| 4,336,727 | 6/1982 | Junkers | 81/57.39 |
| 4,409,865 | 10/1983 | Krautter et al. | 81/57.39 |
| 4,429,597 | 2/1984 | Grabovac et al. | 81/57.39 |
| 4,458,563 | 7/1984 | Bickford et al. | 81/57.39 |

FOREIGN PATENT DOCUMENTS

| | | | |
|---|---|---|---|
| 929426 | 5/1982 | U.S.S.R. | 81/57.39 |

*Primary Examiner*—Frederick R. Schmidt
*Assistant Examiner*—Bradley I. Vaught
*Attorney, Agent, or Firm*—Michael J. Striker

[57] ABSTRACT

A fluid-operated wrench has a support, a ratchet gear mounted on the support turnably about its axis, a pair of driving pawls having free ends engageable with teeth of the ratchet gear, a driving arm which is turnable by a driving element and cooperates with the driving pawls so that during both a forward stroke and a return stroke of the driving element a respective one of the pawls turns the ratchet gear, and a guide which is formed so that the driving arm pivots about its pivot axis and which is located outside and spaced from the pivot axis of the driving arm.

9 Claims, 5 Drawing Figures

FLUID-OPERATED WRENCH

BACKGROUND OF THE INVENTION

The present invention relates to a fluid-operated wrench for tightening or loosening threaded connectors.

Fluid operated wrenches of the above mentioned general type are known in the art. Some of such wrenches are disclosed in my U.S. Pat. Nos. 4,409,865 and 4,368,658, and in my patent application Ser. No. 768,038 pending. In the known fluid-operated wrenches a driving element of drive means is connected with a driving arm in a connecting or leverage axis and pivots the driving arm about its pivot axis. During the pivoting of the driving arm about its pivot axis, the driving arm displaces and turns a respective one of two driving pawls turnable about their axes and turning a ratchet wheel of the wrench. The driving arm is constructed and arranged so that during the forward and the rearward strokes of the driving element of the drive means, the respective driving pawl turns the ratchet wheel in the same direction. The pivot axis of the driving arm is located between the turning axes of the driving pawls and is formed by a pin which extends through an opening in the driving arm. In order to achieve a high multiplying effect, the distances between the turning axis of one pawl and the pivot axis of the driving arm and the turning axis of the other pawl and the pivot axis of the driving arm should be kept as small as possible in comparison with the distance between the connecting or leverage axis and the pivot axis of the driving arm. In the known constructions the distances between the turning axes of the driving pawls and the pivot axis of the driving arm could be reduced only to a certain degree, simply because the guide which insures pivoting of the driving arm about its pivot axis was formed by the above mentioned pin-opening located between the turning axes of the driving pawls, with the respective consumption of the material between the turning axes. Therefore for achieving the required force multiplying effect, the distance between the connecting or leverage point and the pivot point of the driving arm was relatively long, the size of the wrench was big and therefore it was relatively heavy.

SUMMARY OF THE INVENTION

Accordingly, it is an object of the present invention to provide a fluid-operated wrench which avoids the disadvantages of the prior art.

More particularly, it is an object of the present invention to provide a fluid-operated wrench which has a smaller size and a lower weight than the prior art wrenches.

In keeping with these objects and with others which will become apparent herein after, one feature of the present invention resides, briefly stated, in a fluid-operated wrench which has a driving element, a driving arm pivotally connected with the driving element and pivotable about its pivot axis, two driving pawls turnable and displaceable by the driving arm to turn a ratchet wheel in the same direction during both forward and rearward strokes of the driving element, and guiding means for guiding the driving arm so that it pivots about its pivot axis, wherein the driving means is located outside and spaced from the pivot axis of the driving arm so that no guiding means for guiding the driving arm is located in the region of the pivot axis.

In accordance with an advantageous feature of the present invention, the guiding means can be formed as cooperating guiding surfaces formed on the driving arm and on a support of the wrench.

When the fluid-operated wrench is designed in accordance with the present invention, there is no physical means which form the pivot axis of the driving arm and located between the turning axes of the driving pawls. The guiding means which insures pivoting of the driving arm about its pivot axis can be placed at any location outside of the region between the turning axes of the driving pawls. As a result of this, the distance between the turning axes of the driving pawls can be considerably reduced with resulting reduction of the size of the wrench and reduction of its weight.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
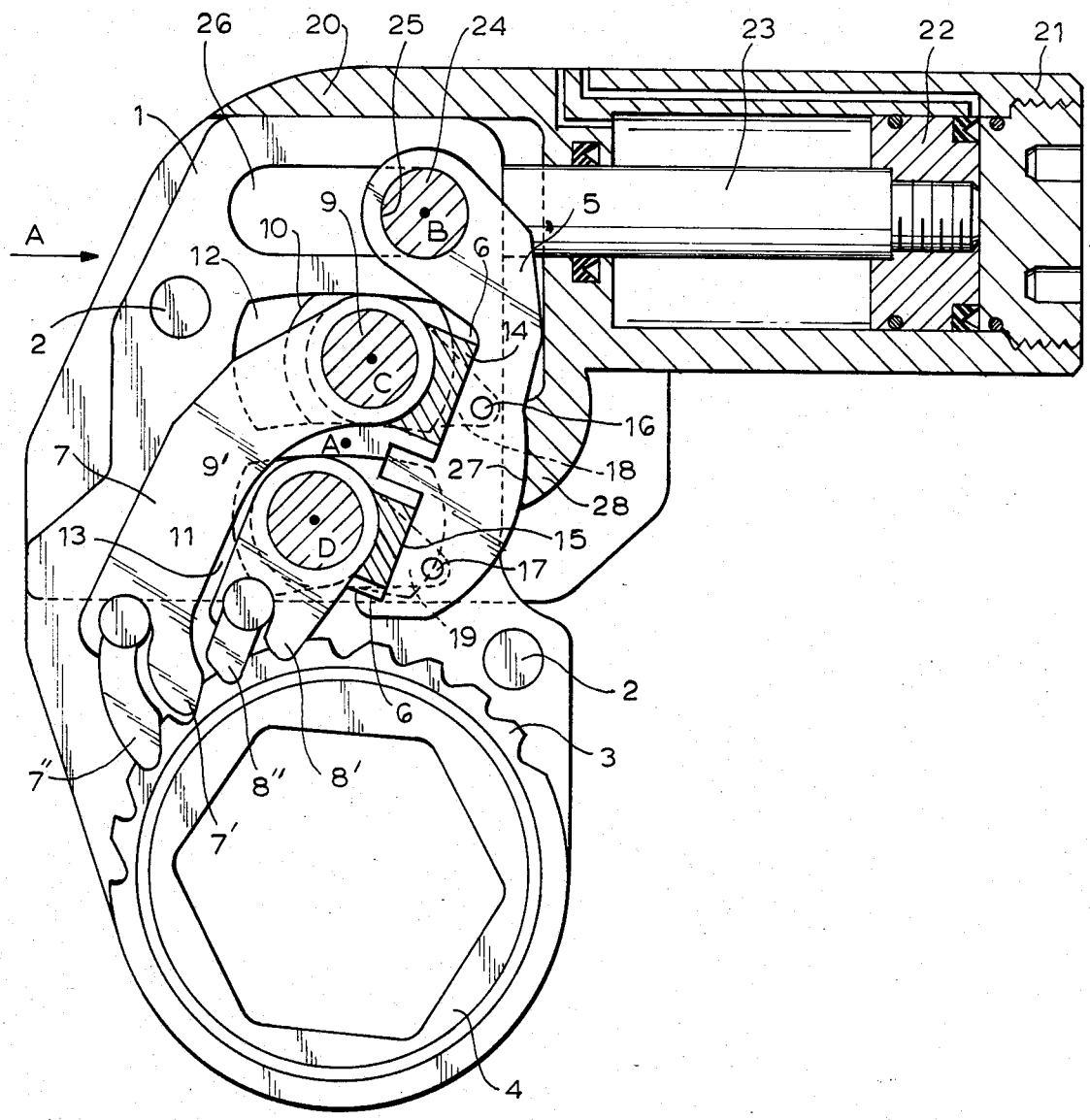
FIG. 1 is a view showing a cross-section of a fluid-operated wrench in accordance with the present invention, taken along the line I—I of FIG. 2.
Figure 2:
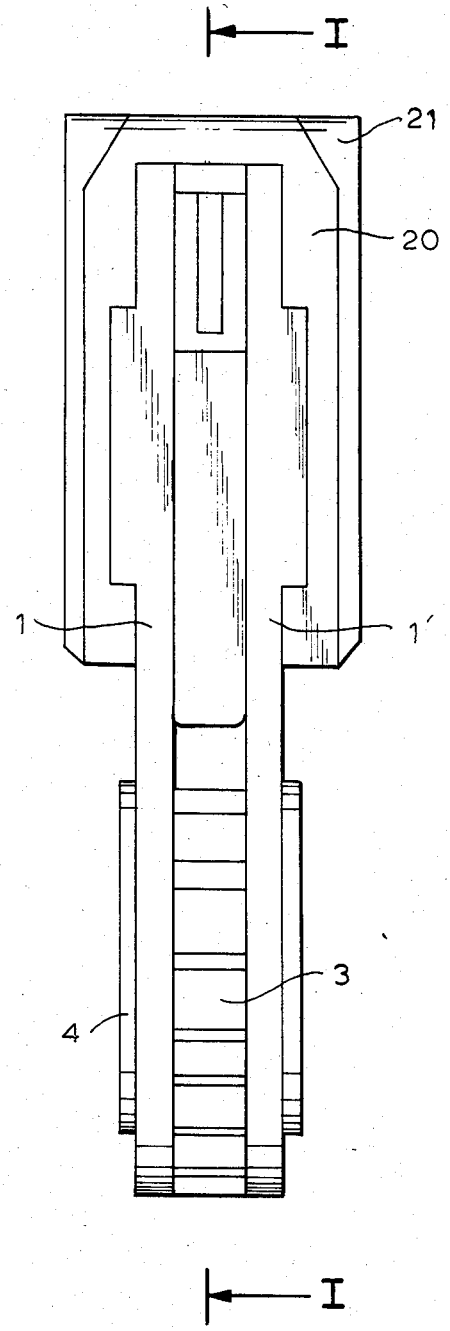
FIG. 2 is a front view of the inventive fluid-operated wrench as viewed in the direction of the arrow A in FIG. 1.
Figure 3:
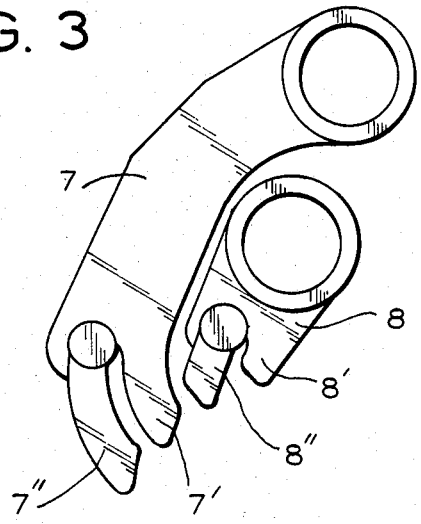
FIG. 3 is a view showing two pawls of the inventive wrench.
Figure 5:
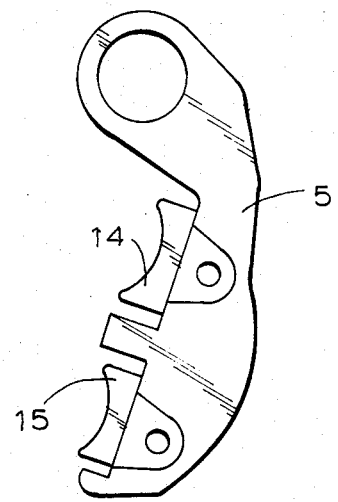
FIG. 5 is a view showing a driving arm of the inventive wrench.
Figure 4:
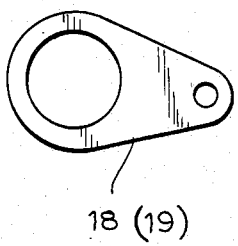
FIG. 4 is a view showing a return link of the inventive wrench.

A fluid-operated wrench in accordance with the present invention, formed for example as a hydraulic wrench, comprises support means including a pair of transversely spaced parallel support plates 1, 1' connected to each other in fixed relationship, for example by a spacing pin 2. A ratchet gear 3 is mounted turnably about its axis between the support plates 1, 1'. For this purpose, the ratchet gear is provided with a pair of trunions 4 projecting at opposite sides of the ratchet gear coaxially therewith and turnably mounted in corresponding bores of the support plates 1 and 1'. A driving arm 5 is sandwiched between opposite faces of the support plate 1, 1'. The driving arm 5 has two recesses 6.

The wrench further comprises a pair of driving pawls 7 and 8 respectively having free ends engaging the teeth of the ratchet gear 3. The driving pawl 7 has a pivot pin 9, while the driving pawl 8 has a pivot pin 9'. Two sliding members 10 are movably mounted on the pivot pin 9 of the driving pawl 7 at opposite axial sides of the pin 9. Similarly two sliding members 11 are movably mounted on the pivot pin 9' of the driving pawl 8 at opposite axial sides of the pivot pin 9'. The sliding members 10 are slidingly guiding in elongated slots 12 of the support plates 1, 1', and the sliding members 11 are slidingly guided in elongated slots 13 of the support plates 1, 1'.

Slide bushings 14 and 15 are arranged in the recesses 6 of the driving arm 5 and have concave surfaces which are in sliding contact with convex surfaces of the ends of the driving pawls 7 and 8 respectively. The driving arm 5 is provided with pin-shaped projections 16 and 17. A return link 18 has two openings and is arranged so that the pin 9 of the driving pawl 7 extends through its one opening and the projection 16 of the driving arm 5 extends through its other opening. A return link 19 also has two openings and is arranged so that the pivot pin 9' of the driving pawl 8 extends through its one opening and the 17 of the driving arm 5 extends through its other opening.

The fluid-operated wrench of the invention further has a one-piece housing with two housing parts 20 and 21. The housing part 20 is U-shaped and formed so that the upper portions of the plate 1, 1' can be inserted into the inner space of the housing part 20, preferably in abutting side-by-side relationship. The housing part 21 forms a cylinder of a fluid-operated cylinder-piston unit, for example a hydraulic cylinder-piston unit. A piston 22 reciprocates in the cylinder of the cylinder-piston unit and is connected to one end of a piston rod 23. The other end of the piston rod 23 is pivotally connected with the driving arm 5 by a pivot pin 24. The pivot pin 24 extends through a bore 25 formed in the driving arm 5 and defines a connecting or leverage axis B. The support plates 1, 1' are provided with elongated slot 26 which extends in the direction of reciprocation of the piston rods 23. The pivot pin 24 also extends through the slots 26 of the support plates 1, 1'.

The slot 26 of the supports are rectilinear. In contrast, the slots 12 and 13 are arcuate and each has upper and lower surfaces, as shown in the drawing, extending along arcuate lines described by two different radii from a center lying on the axis of the ratchet wheel 3.

The driving pawls 7 and 8 are turnable about turning axes C and D defined by the pivot pins 9 and 9'. The driving arm 5 is pivotable about a pivot axis A. The pivot axis A, however, is not formed by any physical element, such a pivot pin or the like. For pivoting the driving arm 5 about the pivot axis A, the driving arm 5 has a guiding surface 27 which slides over a guiding surface 28 provided in the housing. Both surfaces 27 and 28 are curved and extend along an arc described by a radius with a center coinciding with the pivot axis A of the driving arm 1.

As can be seen from the drawings the driving pawls 7 and 8 have a fixed tooth 7' and 8', and a movable tooth 7'' and 8'' which is turnable relative to the respective fixed tooth, to provide more reliable engagement with the teeth of the ratchet wheel 3.

The operation of the above described wrench will be obvious from the description thereof. During the forward stroke of the piston 22, the piston rod 23 moves to the left in FIG. 1, the driving arm 5 slides with its guiding surface 27 over the guiding surface 28 of the housing and is turned in counterclockwise direction, the driving pawl 7 is pushed and turned by the driving arm 5 via the slide bushing 14 and will turn the ratchet gear through a given angle in counterclockwise direction, whereas the driving pawl 8 is pulled by the driving arm via the return link 19 and will move backwards over the teeth of the ratchet gear. During the following return stroke of the piston 22, the piston rod 23 moves to the right, the driving arm 5 slides with its guiding surface 27 over the guiding surface 28 of the housing and is turned in clockwise direction, the driving pawl 8 is pushed and turned by the driving arm 5 via the slide bushing 15 and will turn the ratchet gear through a given angle in the same counterclockwise direction, whereas the driving pawl 7 will be pulled back via the return link 18 over the teeth of the ratchet gear.

As can be seen from the drawing, since no physical means is provided in the region of the pivot axis A of the driving arm 5 forming the pivot axis, such as for example a pin and an opening or the like, the distance ratio between A/C and A/B, and between A/D and A/B is very small and therefore a high force multiplying effect is achieved. At the same time, the size of the fluid-operated wrench is small, as considered in a vertical direction in the drawing, and therefore the wrench has a relatively small weight.

It will be understood that each of the elements described above, or two or more together, may also find a useful application in other types of constructions differing from the types described above.

While the invention has been illustrated and described as embodied in a fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated wrench, comprising support means, a ratchet gear mounted on said support means turnably about its axis and having a plurality of teeth; a pair of driving pawls respectively turnable about their axes and having free ends engageable with said teeth of said ratchet gear; driving means having a driving element reciprocable along a forward and a rearward stroke; a driving arm pivotally connected with said driving element in a connecting axle and cooperating with said driving pawls so that during a forward stroke of said driving element said driving arm displaces and turns one of the driving pawls in a given direction along an active stroke so as to drive said ratchet through a given angle and also displaces and turns the other of said driving pawls along a return stroke to move in a direction opposite to said given direction over at least one tooth of the ratchet gear, while during the rearward stroke of said driving element said driving arm displaces and turns said other driving pawl along its return stroke, said driving arm being pivoted about its pivot axis during reciprocation of said driving element; and guding means for guiding said driving arm so that it is pivoted about said pivot axis, said guiding means for guiding said driving arm being located outside of and spaced from said pivot axis of said driving arm so that guiding of said driving arm during its pivoting is performed only by said guiding means located outside and spaced from said pivot axis, and no guiding means, for guiding said driving arm during its pivoting, is located in the region of said pivot axis.

2. A fluid-operated wrench as defined in claim 1; and further comprising two return links each connecting said driving arm with a respective one of said driving pawls so that during said return strokes said driving arm pulls said driving pawls via said return links.

3. A fluid-operated wrench as defined in claim 1, wherein said support means have two elongated slots, each of said driving pawls being provided with a sliding member which is received in and slides in a respective one of said slots of said support means during said active and return strokes.

4. A fluid-operated wrench as defined in claim 3, wherein each of said slots have two guiding surfaces cooperating with a respective one of said sliding members and described by two radii with a center on said axis of said ratchet gear.

5. A fluid-operated wrench as defined in claim 1, wherein said support means includes a housing provided with a hollow space, and two side plates releaseably insertable in said hollow space of said housing and spaced from one another, said driving arm and said driving pawls being located between said side plates and guided laterally by the latter.

6. A fluid-operated wrench, comprising support means; a ratchet gear mounted on said support means turnably about its axis and having a plurality of teeth; a pair of driving pawls respectively turnable about their axes and having free ends engageable with said teeth of said ratchet gear; driving means having a driving element reciprocable along a forward and a rearward stroke; a driving arm pivotally connected with said driving element in a connecting axle and cooperating with said driving pawls so that during a forward stroke of said driving element said driving arm displaces and turns one of the driving pawls in a given direction along an active stroke so as to drive said ratchet through a given angle and also displaces and turns the other of said driving pawls along a return stroke to move in a direction opposite to said given direction over at least one tooth of the ratchet gear, while during the rearward stroke of said driving element said driving arm displaces and turns said other driving pawl along its active stroke and displaces, and turns said one driving pawl along its return stroke, said driving arm being pivoted about its pivot axis during reciprocation of said driving element; and guiding means for guiding said driving arm so that it is pivoted about said pivot axis, said guiding means for guiding said driving arm being located outside of and spaced from said pivot axis of said driving arm so that no guiding means for guiding said driving arm is located in the region of said pivot axis, said guiding means including a first guiding surface provided on said support means, and a second guiding surface provided on said driving arm and sliding over said first guiding surface.

7. A fluid-operated wrench as defined in claim 6, wherein said guiding surfaces of said guiding means have a circular contour described by a radius with a center on said pivot axis of said driving arm.

8. A fluid-operated wrench as defined in claim 6; and further comprising two slide bushings each arranged between said driving arm and a respective one of said driving pawls so that during said active strokes said driving arm pushes said driving pawls via said slide bushings.

9. A fluid-operated wrench, comprising support means; a ratchet gear mounted on said support means turnably about its axis and having a plurality of teeth; a pair of driving pawls respectively turnable about their axes and having free ends engageable with said teeth of said ratchet gear, each of said driving pawls having a pin; driving means having a driving element reciprocable along a forward and a rearward stroke; a driving arm pivotally connected with said driving element in a connecting axle and cooperating with said driving pawls so that during a forward stroke of said driving element said driving arm displaces and turns one of the driving pawls in a given direction along an active stroke so as to drive said ratchet through a given angle and also displaces and turns the other of said driving pawls along a return stroke to move in a direction opposite to said given direction over at least one tooth of the ratchet gear, while during the rearward stroke of said driving element said driving arm displaces and turns said other driving pawl along its active stroke and displaces and turns said one driving pawl along its return stroke, said driving arm having two pins, said driving arms being pivoted about its pivot axis during reciprocation of said driving element; guiding means for guiding said driving arm so that it is pivoted about said pivot axis, said guding means for guiding said driving arm being located outside of and spaced from said pivot axis of said driving arm so that no guiding means for guiding said driving arm is located in the region of said pivot axis; and two return links each connecting said driving arm with a respective one of said driving pawls so that during said return strokes said driving arm pulls said driving pawls via said return links, each of said return links having two openings engaging with said pin of a respective one of said driving pawls and with one of said pins of said driving arm.

* * * * *